United States Patent [19]

Thumm et al.

[11] Patent Number: 4,460,132

[45] Date of Patent: Jul. 17, 1984

[54] PULPER FOR PRODUCING PAPER PULP SUSPENSIONS

[75] Inventors: Helmut Thumm; Theodor Bähr; Herbert Ortner, all of Heidenheim, Fed. Rep. of Germany

[73] Assignee: J. M. Voith GmbH, Fed. Rep. of Germany

[21] Appl. No.: 390,297

[22] Filed: Jun. 21, 1982

Related U.S. Application Data

[63] Continuation of Ser. No. 145,311, Apr. 29, 1980, abandoned.

[30] Foreign Application Priority Data

May 3, 1979 [DE] Fed. Rep. of Germany ..... 2917814

[51] Int. Cl.[3] ..... B02C 13/16; B02C 18/22

[52] U.S. Cl. ..... 241/46.11; 162/261; 241/46.17

[58] Field of Search ..... 162/261, 236, 19, 20, 162/26, 57, 28, 251, 4; 241/28, 260.1, 247, 46.11, 46.17

[56] References Cited

U.S. PATENT DOCUMENTS 3,533,563 10/1970 Eriksson ..... 241/28
3,595,488 7/1971 Blakley et al. ..... 241/28
3,946,951 3/1976 Danforth ..... 241/28

FOREIGN PATENT DOCUMENTS 760707 6/1967 Canada ..... 162/251
2301996 1/1974 Fed. Rep. of Germany .
2702653 7/1978 Fed. Rep. of Germany ... 241/260.1
269700 8/1970 U.S.S.R. ..... 162/28

*Primary Examiner*—Steve Alvo
*Attorney, Agent, or Firm*—Ostrolenk, Faber, Gerb & Soffen

[57] ABSTRACT

An apparatus for pulping paper into a pulp suspension is disclosed. A vertical container has an upper paper pulping zone and a lower pulp diluting and outlet zone beneath the pulping zone. A narrowed despecking slot communicates between the two zones. A rotor in the container circulates and breaks up the paper in the presence of the liquid in the pulping zone. Ribs on the rotor cooperate with stators in the container for defining the despecking slot. A pulp suspension dilution water inlet communicates into the dilution zone. The outlet from the container also communicates from the dilution zone. A screen protects the outlet from the dilution zone against exit of large particles therethrough and vanes on the rotor clean the screen.

17 Claims, 4 Drawing Figures

PULPER FOR PRODUCING PAPER PULP SUSPENSIONS

RELATED APPLICATIONS

This is a continuation of U.S. patent application Ser. No. 145,311, filed Apr. 29, 1980, now abandoned.

BACKGROUND OF THE INVENTION

The invention relates to a pulper, especially one that operates to initially produce paper pulp suspensions in the high pulp density range, e.g. above 8% pulp density. More particularly, the invention concerns means for enabling the pulping container of the pulper to not be enlarged, even though the pulp suspension is diluted to a desirable lower pulp density, which enables the suspension to be pumped.

A known mechanical pulper includes a container which is enclosed and defined by a wall and includes a circulator member, which moves through the container to break up and disintegrate the paper being pulped. The circulator member is often located in the region of the wall. The outlet opening for the pulp suspension is arranged in the wall of the container in the region of the circulation member.

For producing an aqueous pulp suspension, from waste paper for instance, bales of waste paper are broken up or disintegrated in the presence of added water in a pulper. It is advantageous in many cases not to dilute the suspension with excess water. Thus, for instance, producing pulp in a high pulp density range helps save energy. (The pulp density range is a ratio, stated in percentage, of the weight of solid materials per unit of liquid volume of the suspension, e.g. grams per liter of suspension.)

However, upon disintegration of paper to produce pulp in the high pulp density range, problems arise with respect to sufficient circulation of the suspension in the container and with respect to dilution of the suspension after the pulping process so as to obtain a pumpable suspension. Pulp that is too dense undesirably cannot be pumped. For these reasons, the circulator or pulping members now used have knives, impact edges, etc. in order to satisfactorily disintegrate the paper. When the pulping process has been completed, water for diluting the suspension has been added to the entire pool of suspension until the suspension in the container has a pulp density of less than 8%. The pulp density level is selected so that the suspension is then pumpable. The disadvantage of having to dilute all of the suspension, however, is that the pulping container has to be correspondingly over-sized. During the disintegration of the paper, the container could be only partially filled, since the required water of dilution had to be later introduced. For example, upon disintegration of paper in a pulp density range of 16% and with subsequent dilution of the pulp to a pulp density of less than 7%, the container has to be sized so that it would be able to receive two or three times the quantity of paper being pulped.

SUMMARY OF THE INVENTION

The object of the present invention is, therefore, to create a pulper of the aforementioned type, wherein waste paper can be sufficiently beaten to produce a pulped suspension, which suspension can then be pumped away from the pulper without a detrimental increase in the size of the container.

In accordance with the invention, the circulation member in the form of a rotor and the container wall around the rotor are so developed in the regions facing each other that a pulp suspension dilution zone i.e. chamber is produced between them. The dilution zone i.e. chamber communicates with and receives already pumped suspension from the pulping zine i.e. chamber in the remainder of the container. A suspension diluting water conduit discharges into the dilution zone. The dilution zone is located in front of the outlet opening from the container. The disintegration of the paper in the pulping zone of the container in a pulp density range of more than 8% customarily is effected by multiple circulation by the circulation member. With the invention, a circulating movement or eddying of the suspension, which is independent of operation of the circulation member, takes place simultaneously with the dilution of the suspension in the newly created dilution zone i.e. chamber in front of the outlet opening. In this way, suspension at a pumpable density is obtained in the vicinity of the outlet opening from the container and the diluted pulp suspension cam be pumped out of the container without the level of the suspension in the container having to be increased over the level thereof when the paper is being pulped at a high pulp density.

In the pulping zone i.e. chamber, the circulation member may be provided with ribs on the side thereof facing the wall of the container for intensifying the circulating movement in the pulping zone. Furthermore, the circulation member, and particularly the ribs thereof, may cooperate with stators arranged on the wall of the container, and the circulation member or its ribs and the stators are so shaped and positioned that together they form a despecking or fiberizing slot for the suspension to pass through as it is transmitted to the dilution zone. This assures that undisintegrated bundles of fibers do not enter the dilution zone.

In one embodiment of the invention, a screen basket is arranged in front of the outlet opening, and the basket is coaxial to the axis of the rotating circulating member. The screen basket prevents bundles of unpulped paper fibers from passing into the dilution zone. In a further aspect of this embodiment, the circulation member has screen basket cleaning vanes at its periphery which rotate in front of the screen basket.

Good disintegration of the paper into a pulp suspension is obtained where the circulation member is developed as a rotor which is provided with helical vanes and where the vanes are in part interrupted along their lengths to form impact edges. As a result, the rotor advantageously acts as a shredding member for the paper bales.

In another embodiment, the rotor vanes are provided with generally hook-shaped, jagged edged or otherwise shaped projections. This also causes the vanes to act as paper shredding members.

Other objects and features of the invention are described below with reference to the accompanying drawings.

DESCRIPTION OF THE PREFERRED EMBODIMENTS

Figure 1:
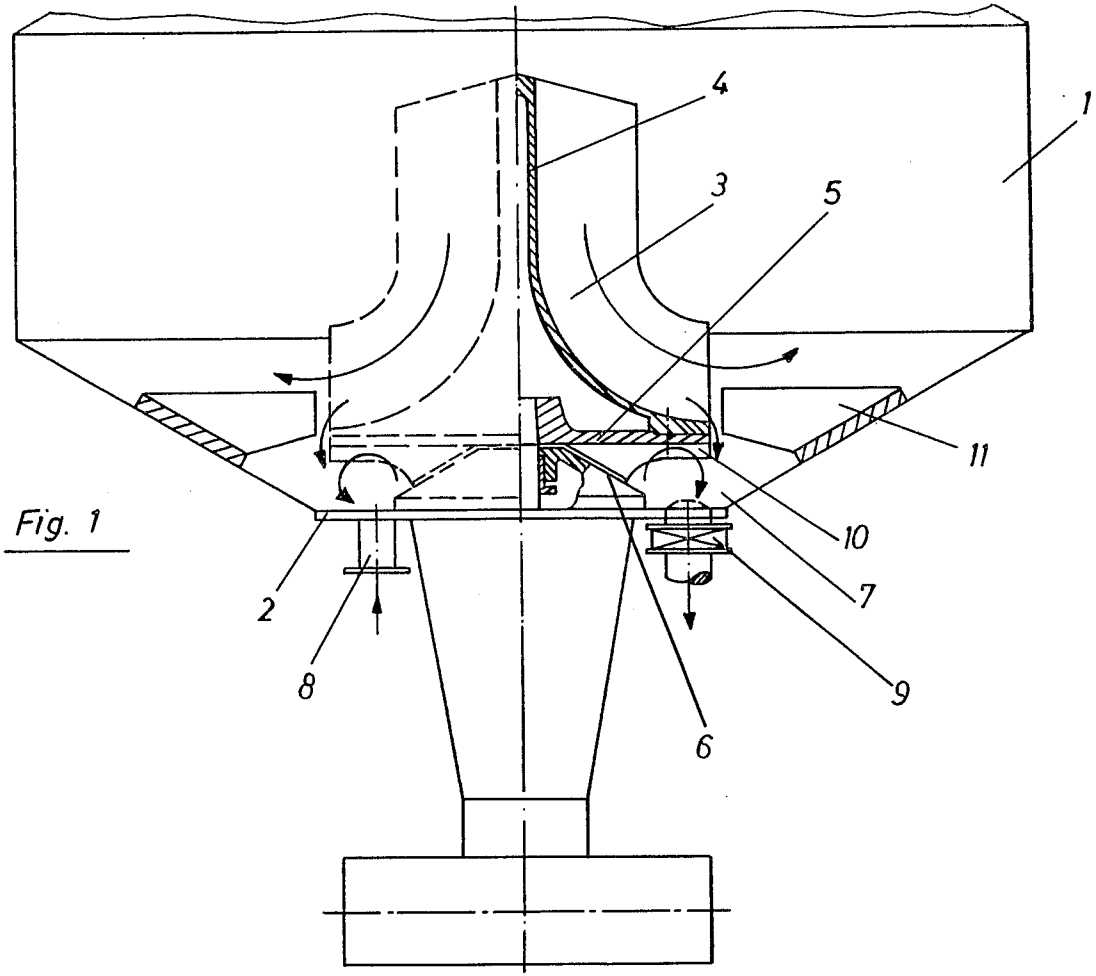
FIG. 1 is a cross-sectional view through an embodiment of a pulper.

A pulp suspension is to be formed from paper within a vertical container 1 of cylindrical shape. The container includes frustoconical extensions in its upper and lower regions.

A circulation member 3, in the form of a vertical rotor with vertical rotation axis and axially extending, helical vanes 4 thereon, is inserted through the bottom 2 of the container. The rotor 3 and the plate 5 at the bottom of the rotor are spaced by a spacer 6 at a distance from and are opposed to the bottom 2 of the container. In this way a space, i.e. dilution zone i.e. chamber 7, is produced between the bottom of the rotor 3 and the bottom wall 2 of the container. A suspension diluting water inlet conduit 8 discharges through bottom wall 2 into the region of the dilution zone 7. The disintegrated pulp suspension is removed from the container via an outlet opening 9 located in the zone 7 and also in the bottom wall of the container and spaced from the inlet conduit 8. The outlet opening 9 is preferably provided with a screen for blocking outlet therethrough of unpulped paper and fibers and other large impurities.

The rotor plate 5 is provided on its bottom side with downwardly projecting, radially extending ribs 10. The wall of the container carries stators 11 to serve as impact members. The stators 11 extend up almost to the periphery of the rotor 3 and the radially outer edges of the ribs 10 and this forms a despecking or fiberizing slot between the radially inner ends of the stators and the radially outer edges of the rotor and ribs 10. The despecking slot is at the top of the dilution zone 7.

The bales of waste paper to be disintegrated and pulped are introduced generally from above into the main pulping zone i.e. chamber of the container 1. Water is simultaneously added into this zone of the container through an inlet (not shown). However, only enough water is added to that the pulp is diluted to a pulp density of not less than 8%. It is preferred to operate the pulper in a pulp density range of 12–15%.

In the pulping zone i.e. chamber, the rotor 3 is provided with impact members (detailed with respect to FIGS. 3 and 4) by which the paper is disintegrated. This assures the required circulation of the suspension in the directions indicated by the arrows. Pulp which has been sufficiently disintegrated settles and passes through the continuously open despecking or fiberizing slot between the stators 11 and the rotor 3, into the dilution zone i.e. chamber 7 at the bottom of the container, under the rotor. Water entering through the dilution-water line 8 dilutes the suspension in the dilution zone 7 to a pumpable pulp density, which is less than 8%. The diluted pulp is removed through the outlet opening 9.

Because the dilution zone 7 is separated from the pulping or disintegration zone, which is in the region of the rotor 3, the contents of the entire container 1 need not be diluted correspondingly to the level of dilution of the pulp in the zone 7. For this reason, it is possible to completely fill the container 1 with paper to be disintegrated. In order to maintain a constant level in the container, it is advantageous for the amount of dilution water added to the container through inlet 8 to be a function of the amount of the disintegrated pulp suspension which is removed.

Figure 2:
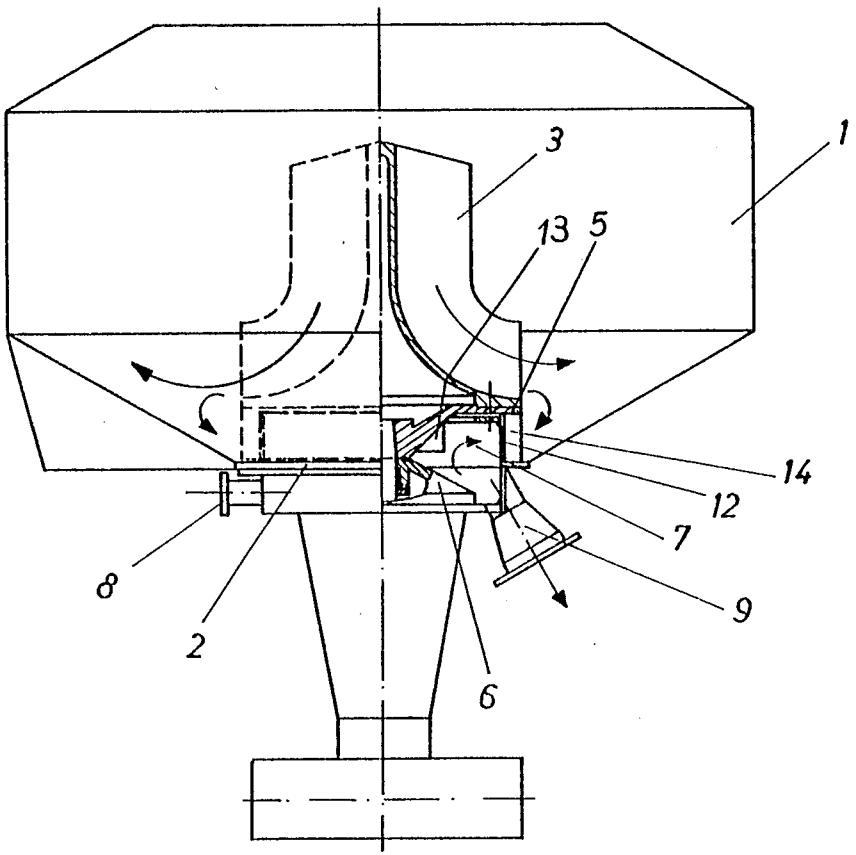
FIG. 2 is a cross-sectional view through another embodiment of a pulper.

FIG. 2 shows a similar pulping apparatus to that of FIG. 1. In this case, the dilution zone i.e. chamber 7 is even more clearly defined. In front of the inlet of the pulped suspension into the dilution zone 7, there is a stationary screen basket 12, which prevents insufficiently disintegrated paper or materials from entering the zone 7 and then leaving through the outlet opening 9. For better circulation of suspension in the zone i.e. chamber 7, downwardly projecting ribs 13 are also provided on the bottom of the plate 5.

The rotor 3 is also provided on its periphery with downwardly projecting cleaning vanes 14, which are directed toward the bottom 2 of the container. They are shaped and placed to travel just in front of the screen basket 12 in order to clean it. The flow prevailing in the circulation zone 7 is indicated by an arrow.

Figure 3:
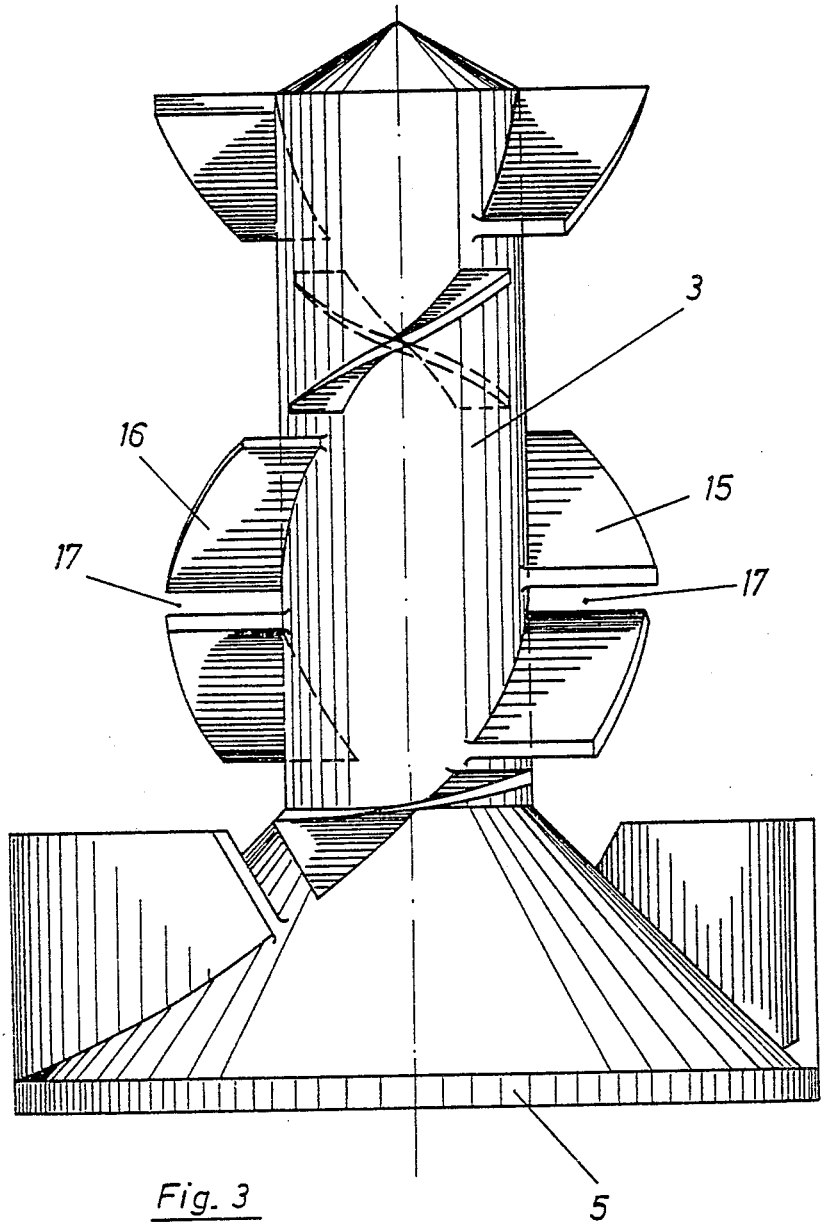
FIG. 3 is an elevational view of a portion of a rotor for use in a pulper embodiment and provided with interrupted helical vanes.
Figure 4:
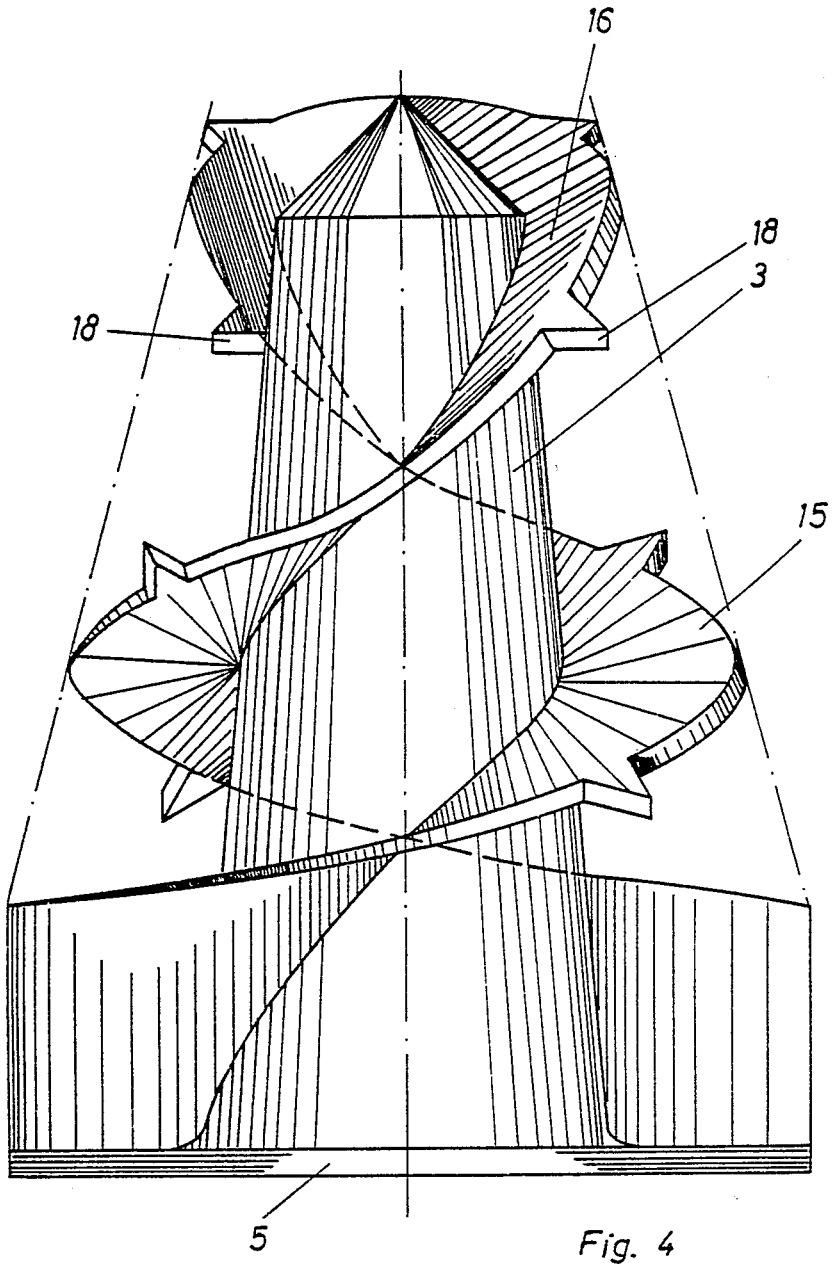
FIG. 4 is an elevational view of a portion of another rotor having jagged projections on the helical vanes.

FIGS. 3 and 4 show two embodiments of rotors 3. Both rotors have one or more (two being shown), axially extending, helical vanes 15 and 16. Impact elements are formed in the helical vanes 15 and 16 to shred the paper. In FIG. 3, the impact elements comprise interruptions 17 at spaced locations along the vanes. The uninterrupted helical vanes 15 and 16 of FIG. 4 are provided with generally jagged, e.g. hook-shaped or triangularly shaped projections 18 which serve as impact elements for shredding the paper.

Although the present invention has been described in connection with preferred embodiments thereof, many variations and modifications will now become apparent to those skilled in the art. It is preferred, therefore, that the present invention be limited not by the specific disclosure herein, but only by the appended claims.

What is claimed is:

1. A pulper for producing a pulp suspension of paper, comprising:

a container having a wall; a rotor for pulp circulation in the container, the rotor being rotatable around an axis in the container in the region of the container wall, and the rotor facing toward the wall; the rotor being shaped for passing around the container wall and for disintegrating paper in the container; a pulping chamber being defined in the upper part of the container at and around the rotor, the rotor serving for disintegrating paper into pulp suspension in the pulping chamber;

the rotor and the wall also being so shaped and placed with respect to each other that a pulp suspension dilution chamber, in communication with the pulping chamber, is defined in the bottom part of the container; the rotor having a bottom side, intersected by the axis thereof, and the bottom side of the rotor being in and also defining the top side of the dilution chamber, and the rotor bottom side having means thereon for stirring said suspension in the dilution chamber; an outlet opening for pulp suspension in the wall and located in the dilution chamber; a pulp suspension dilution water conduit for discharging water into the dilution chamber whereby the suspension in the dilution chamber will be more diluted than the suspension in the pulping chamber.

2. The pulper of claim 1, wherein the rotor has ribs defined thereon on the side thereof facing toward the wall and the ribs projecting toward the wall and the communication between the pulping chamber and the dilution chamber passes the ribs.

3. The pulper of claim 2, further comprising stators positioned at the container wall in the container in the pulping chamber and with respect to which the rotor moves and the stators extending toward the rotor ribs for cooperating therewith.

4. The pulper of claim 3, wherein the stators project toward the ribs near enough for defining a despecking and fiberizing slot between the ribs and the stators and the communication between the pulping chamber and the dilution chamber passes the despecking and fiberizing slot.

5. The pulper of claim 1, further comprising stators positioned on the wall of and in the container in the pulping chamber and with respect to which the rotor moves, and the stators extending toward the rotor for cooperating therewith; and the communication between the pulping chamber and the dulution chamber passes the stators.

6. The pulper of claim 5, wherein the stators project toward the rotor near enough for defining a despecking and fiberizing slot between the rotor and the stators and the communication between the pulping chamber and the dilution chamber passes the despecking and fiberizing slot.

7. The pulper of claim 1, further comprising a screen arranged in front of the outlet opening for screening unpulped paper and other large objects from passing through the outlet opening.

8. The pulper of claim 1, further comprising a screen basket at the dilution chamber and arranged in front of the outlet opening for screening unpulped paper and other large objects from passing through the outlet opening, the screen basket being annular and coaxial with the rotor.

9. The pulper of claim 8, further comprising cleaning vanes supported on the rotor; the cleaning vanes rotating along with the rotor and extending past and in front of the screen basket for clearing materials off the screen basket as the rotor rotates.

10. The pulper of claim 1, wherein the rotor includes at least one vane on the periphery thereof and in the pulping chamber for aiding circulation in the pulping chamber and for impacting against the paper in the pulping chamber.

11. The pulper of claim 10, wherein the vane on the rotor extends axially therealong.

12. The pulper of claim 13, wherein the vane is helically wound around the rotor.

13. The pulper of either of claims 11 or 12, wherein there are a plurality of the vanes on the rotor.

14. The pulper of claim 13, wherein two of the vanes are helically wound around the rotor.

15. The pulper of any of claims 10, 11 or 14, wherein the vane is interrupted along the length thereof to define impact edges for aiding in shredding of the paper in the dilution zone of the container.

16. The pulper of any of claims 10, 11 or 12, wherein the vane has generally jagged projections defined thereon to define impact edges for aiding in shredding of the paper in the dilution chamber of the container.

17. The pulper of claim 1, further comprising ribs defined on the rotor bottom side in the dilution zone and disposed opposite the bottom of the container, and the ribs being for stirring the suspension in the dilution chamber.

* * * * *